US005749337A

United States Patent [19]

Palatov

[11] Patent Number: 5,749,337

[45] Date of Patent: May 12, 1998

[54] BARREL TYPE INTERNAL COMBUSTION ENGINE

[76] Inventor: Dennis Palatov, 36 Nightingale Dr., Aliso Viejo, Calif. 92656

[21] Appl. No.: 829,282

[22] Filed: Mar. 31, 1997

[51] Int. Cl.[6] ..... F02B 75/06

[52] U.S. Cl. ..... 123/56.2; 123/56.5; 123/62

[58] Field of Search ..... 123/56.1, 56.2, 123/56.3, 56.5, 56.6, 56.9, 61 R, 62

[56] References Cited

U.S. PATENT DOCUMENTS

| | | | |
|---|---|---|---|
| 2,026,705 | 1/1936 | Pratt | 123/56.5 |
| 2,243,817 | 5/1941 | Herrmann | 123/41.31 |
| 2,983,264 | 5/1961 | Herrmann | 123/56.8 |
| 3,040,721 | 6/1962 | Schotthoefer | 123/56.2 |
| 4,448,154 | 5/1984 | Kossel | 123/56.5 |
| 4,492,188 | 1/1985 | Palmer et al. | 123/56.8 |
| 4,565,165 | 1/1986 | Papanicolaou | 123/56.2 |
| 4,635,590 | 1/1987 | Gerace | 123/56.2 |
| 4,887,558 | 12/1989 | Bernard | 123/62 |
| 5,027,756 | 7/1991 | Shaffer | 123/56.5 |
| 5,218,933 | 6/1993 | Ehrlich | 123/56.2 |
| 5,437,251 | 8/1995 | Anglim et al. | 123/56.3 |

FOREIGN PATENT DOCUMENTS

| | | | |
|---|---|---|---|
| 213152 | 1/1961 | Austria | 123/56.5 |

*Primary Examiner*—David A. Okonsky
*Attorney, Agent, or Firm*—Morland C. Fischer

[57] ABSTRACT

A barrel type engine with two-stroke cycle of operation. The engine of the present invention comprises two engine halves, each half having a plurality of pumping cylinders and a matching number of power cylinders. Double-ended pistons impart rotational motion to the engine shaft by a cam. The cylinder arrangement of the present invention facilitates efficient communication of intake air between the pumping cylinders and the power cylinders contained within each engine half, and further establishes a natural and beneficial timing relationship between the action of the pumping cylinders and the action of the corresponding power cylinders. In operation, intake air is drawn into the pumping cylinders and then transferred to the power cylinders by a transfer duct system. Due to the natural timing characteristics inherent in the engine of the present invention, intake air is forcibly transferred to the power cylinders with minimum parasitic pumping loss, ensuring favorable cylinder scavenging and filling for maximum efficiency. The diameter of the pumping cylinders is larger than that of the power cylinders, resulting in a net supercharging effect and further enhancing power output. The present invention takes advantage of the inherent characteristics of barrel type engines to achieve favorable intake and exhaust gas flow, resulting in increased power and efficiency.

10 Claims, 6 Drawing Sheets

BARREL TYPE INTERNAL COMBUSTION ENGINE

1. Field of the Invention

The present invention relates to the field of internal combustion engines and, more specifically, to barrel type engines with a two-stroke operating cycle.

2. Background Art

Barrel type engines were originally disclosed by Herrmann in U.S. Pat. No. 2,243,817 and others. Engines of this type have a plurality of cylinders arranged circularly around and parallel to the engine shaft. Pistons, commonly of double-ended construction, are slidably received in cylinder bores and impart rotational motion to the engine shaft by means of a cam.

The primary advantage of barrel type engines is the efficient packaging of cylinders, resulting in a significantly smaller and lighter unit than a conventional engine of equal displacement. An added benefit of this engine type, in many configurations, is near-perfect balance resulting in the absence of vibration. Unfortunately, as a consequence of the compact packaging, intake and exhaust porting is usually compromised in existing barrel type engine designs. When using a four-stroke cycle of operation, the arrangement of valves dictated by the barrel type layout compromises intake port and combustion chamber shapes, limiting the amount of horsepower such engines can produce. A barrel type engine of 6.1 liter displacement is currently being manufactured by Dyna-Cam Industries of California. This engine produces 210 horsepower using aviation fuel with no emission controls. This level of power output is commonly seen in conventional automotive engines of 3.0–4.0 liters in displacement, with full emissions compliance and using ordinary pump gasoline.

Further, in a four-stroke cycle barrel type engine a circular exhaust manifold is required at each end of the engine. Such manifolds are difficult to mass-produce and present routing and heat management difficulties when mounting the engine in a vehicle. An example of such engine is disclosed by Palmer in U.S. Pat. No. 4,492,188, a design that is currently being manufactured for use in aircraft. It is believed that the difficulties in manufacturing and installing these engines are among the primary factors that have limited the market acceptance of the design in the several decades that it has been available. It is then apparent that a barrel type engine with a two-stroke cycle of operation would have some advantages over the existing designs.

A two-stroke cycle engine is highly dependent on optimal intake and exhaust flow to achieve power and efficiency. Due to the compactness of the cylinder layout, efficient gas flow is difficult to achieve in engines of barrel type. Herrmann disclosed an engine of barrel type in U.S. Pat. No. 2,983,264 and others that use one half of the engine to compress intake air. The compressed air is then communicated to the combustion half of the engine by means of a hollow shaft and associated valving apparatus. Such an engine can be configured to be capable of two-stroke cycle operation. Unfortunately, the necessity for large port openings in the walls of the hollow engine shaft to facilitate adequate gas flow is in direct conflict with structural strength requirements for the highly stressed shaft, likely resulting in reduced useful power output.

What is needed is an engine design that would take full advantage of the inherent packaging efficiency of the barrel type layout, yet would feature optimized intake and exhaust flow for maximum power output and efficiency. The design must be easy and economical to manufacture in large quantities, minimizing both parts count and machining operations. Further, the design should facilitate intake and particularly exhaust routing that would enable low cost installation of the engine in a wide variety of vehicles.

SUMMARY OF THE INVENTION

A first objective of the present invention is an improved design of a barrel type engine that would be suitable for manufacture in large quantities and would facilitate low-cost installation of the engine in a wide variety of vehicles. To achieve the first objective, the engine of the present invention provides several key features. Two-stroke cycle operation is provided, with intake and exhaust ports controlled by the power piston in each cylinder, as is common practice in conventional two-stroke cycle engine design. The two-stroke cycle operation facilitates the elimination of intake and exhaust poppet valves and their associated apparatus as well as machining operations used in their manufacture. Exhaust ports are on the side of the engine block to simplify exhaust manifold construction and routing. The engine has a high degree of symmetry allowing for the use of a plurality of substantially identical parts in the assembly for improved manufacturing efficiency. The location of the exhaust ports on the side of the engine block allows unobstructed access to both ends of the engine and engine shaft. Such access in turn enables vehicle designers to take full advantage of the very low vibration levels inherent in the barrel type engine layout by using the engine of the present invention as a structural member of a vehicles chassis. Vehicles designed specifically to accept the engine of the present invention can thus be constructed with fewer parts, less weight and at a lower cost than those designed for conventional engines. Vehicle weight reduction has been shown to result in significant energy savings in vehicle manufacture and operation. By utilizing the apparatus of the present invention and the advantages inherent therein a substantial cost reduction is achieved, not only in the manufacture of the engine of the present invention but also in the manufacture and subsequent operation of vehicles designed specifically to accept said engine.

A second objective of the present invention is to improve the power output and efficiency of a barrel type engine by facilitating two-stroke cycle operation with favorable intake and exhaust flow characteristics. The engine of the present invention utilizes an equal number of power cylinders and pumping cylinders, each cylinder being formed by slidably receiving one end of a double-ended piston in a cylinder bore. An even number of double-ended pistons is utilized. A key innovation of the present invention lies in placing equal numbers of pumping cylinders and power cylinders within each engine half. This is in contrast to the arrangement disclosed by Herrmann in U.S. Pat. No. 2,983,264, said arrangement having all pumping cylinders contained in one engine half and having all power cylinders contained in the other engine half. The cylinder arrangement of the present invention facilitates efficient communication of intake air between the pumping cylinders and the power cylinders contained within each engine half and further establishes a natural and beneficial timing relationship between the action of the pumping cylinders and the action of the corresponding power cylinders, thereby enabling the engine of the present invention to achieve the second objective. In accordance with the present invention, the engine assembly is composed substantially of two halves, each engine half having a plurality of pumping cylinder bores and further having a matching number of power cylinder bores. A plurality of double-ended pistons are slidably received in said cylinder bores.

In a first embodiment of the present invention, an engine is described having an even number of identical pistons, each piston having a power end and a pumping end. The engine halves are constructed and assembled so as to align each power cylinder bore of the first engine half with a pumping cylinder bore of the second engine half and to further align each power cylinder bore of the second engine half with a pumping cylinder bore of the first engine half. The double-ended pistons are slidably received in the assembly with the power end being received in the power cylinder bores and the pumping end being received in the aligned pumping cylinder bores.

In a second embodiment of the present invention, an engine is described having a plurality of double-ended power pistons and further having a matching number of pumping pistons. The engine halves are constructed and assembled so as to align each power cylinder bore of the first engine half with a power cylinder bore of the second engine half and to further align each pumping cylinder bore of the second engine half with a pumping cylinder bore of the first engine half. The power pistons are slidably received in the aligned power cylinder bores of the assembly and the pumping pistons are slidingly received in the aligned pumping cylinder bores of the assembly. In order to maintain the primary balance inherent in barrel-type engines, the pumping pistons must have the same mass as the power pistons.

Each engine half of the present invention comprises intake valve apparatus and further comprises a transfer duct system to place the pumping cylinders in communication with the power cylinders. The intake valve apparatus may be of any type commonly used in the art, including but not limited to poppet, reed and rotary valves. Fuel may be added to intake air upstream of the pumping cylinders, inside the pumping cylinders, inside the transfer duct system, or inside the power cylinders by any means known in the art, including but not limited to carburetion and injection.

In operation, intake air is drawn into the pumping cylinders and then transferred to the power cylinders by means of the transfer duct system. Due to the natural timing characteristics inherent in the engine of the present invention, intake air is forcibly transferred to the power cylinders with minimum parasitic pumping loss, ensuring favorable cylinder scavenging and filling for maximum efficiency. The pumping cylinders of the present invention do not require a cooling jacket and can generally be weaker in construction than the power cylinders. The diameter of the pumping cylinders can therefore be made larger than that of the power cylinders without any increase in engine block size. Such increase in pumping cylinder diameter results in an intake air volume greater than the displacement of the power cylinders and therefore a net supercharging effect, further enhancing power output. The unique configuration of the present invention takes advantage of the inherent characteristics of barrel type engines to achieve favorable intake and exhaust gas flow resulting in increased power and efficiency as compared to designs of prior art.

BRIEF DESCRIPTION OF THE DRAWINGS

The invention, its configuration, construction, and operation will be best described in the following detailed description, taken in conjunction with the accompanying drawings in which.

DETAILED DESCRIPTION OF THE PREFERRED EMBODIMENT

In the following description numerous references are made to engine halves. In the context of the present invention, an engine half is the portion of the engine assembly lying entirely on one side of a plane, said plane being perpendicular to the engine shaft axis and passing substantially through the midpoint of the engine shaft. It is possible to construct embodiments of the present invention such that portions of one or more engine assembly components would lie in different engine halves.

Figure 1:
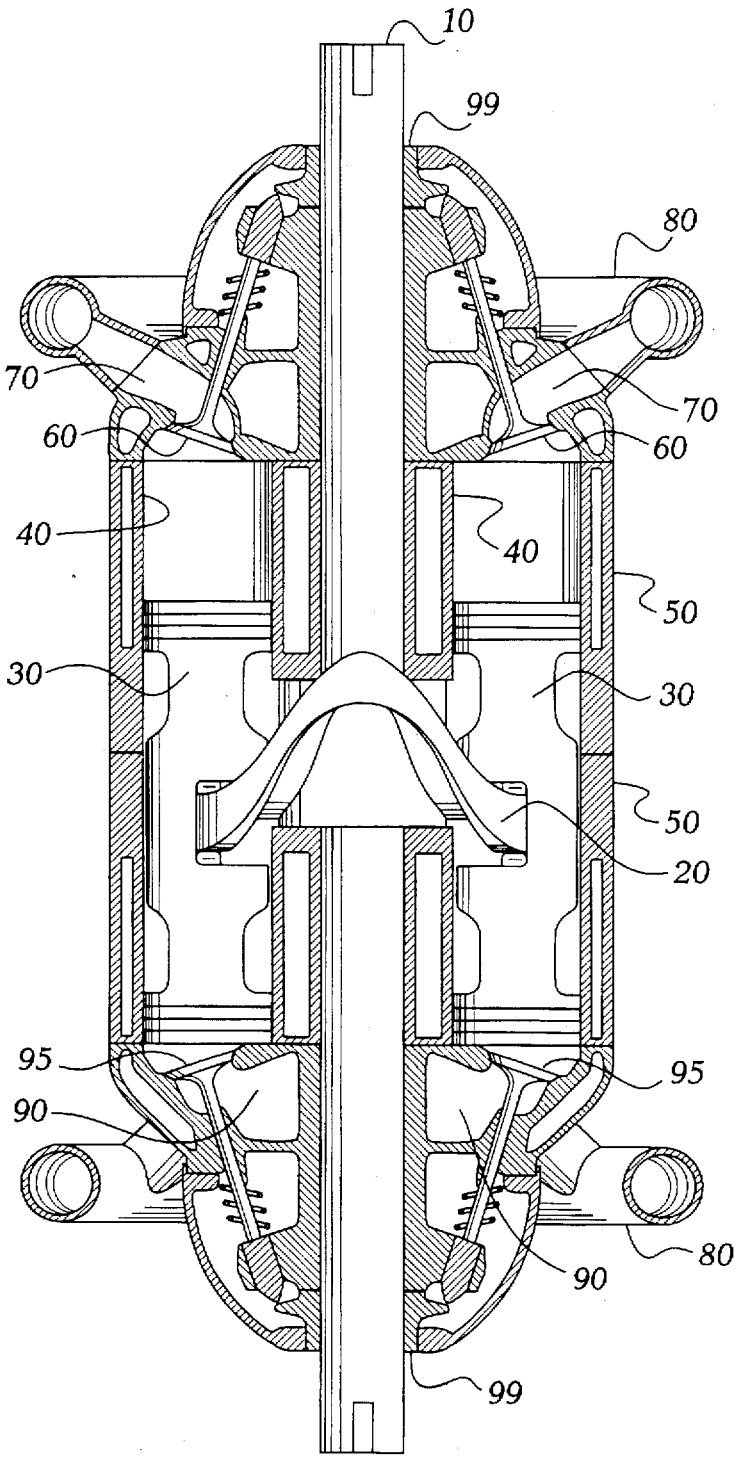
Figure 1 (Prior Art)
FIG. 1 is a cross-sectional view of a four-stroke cycle barrel type engine of the prior art.

A well known barrel type engine is illustrated in FIG. 1, the engine having pistons 30 slidably received in cylinder bores 40 of engine halves 50. The pistons transmit power to engine shaft 10 by means of cam 20. Due to the four-stroke working cycle typical of such engines, intake valves 95 are of poppet type. Further, exhaust valves 60 are required and are also of the poppet type. Both sets of valves are operated by a valve actuating cam 99. FIG. 1 illustrates the restricted space available for intake ports 90 and the awkward construction of exhaust manifolds 80 that is inherent in such a design. Access to either end of the engine for the purpose of engine mounting and attaching a power transmission mechanism such as those common in automotive applications is compromised by the need to clear the circular exhaust manifolds. The restricted intake porting creates a high pressure drop at high gas flow rates, limiting the amount of power the engine can generate without external supercharging.

Figure 2:
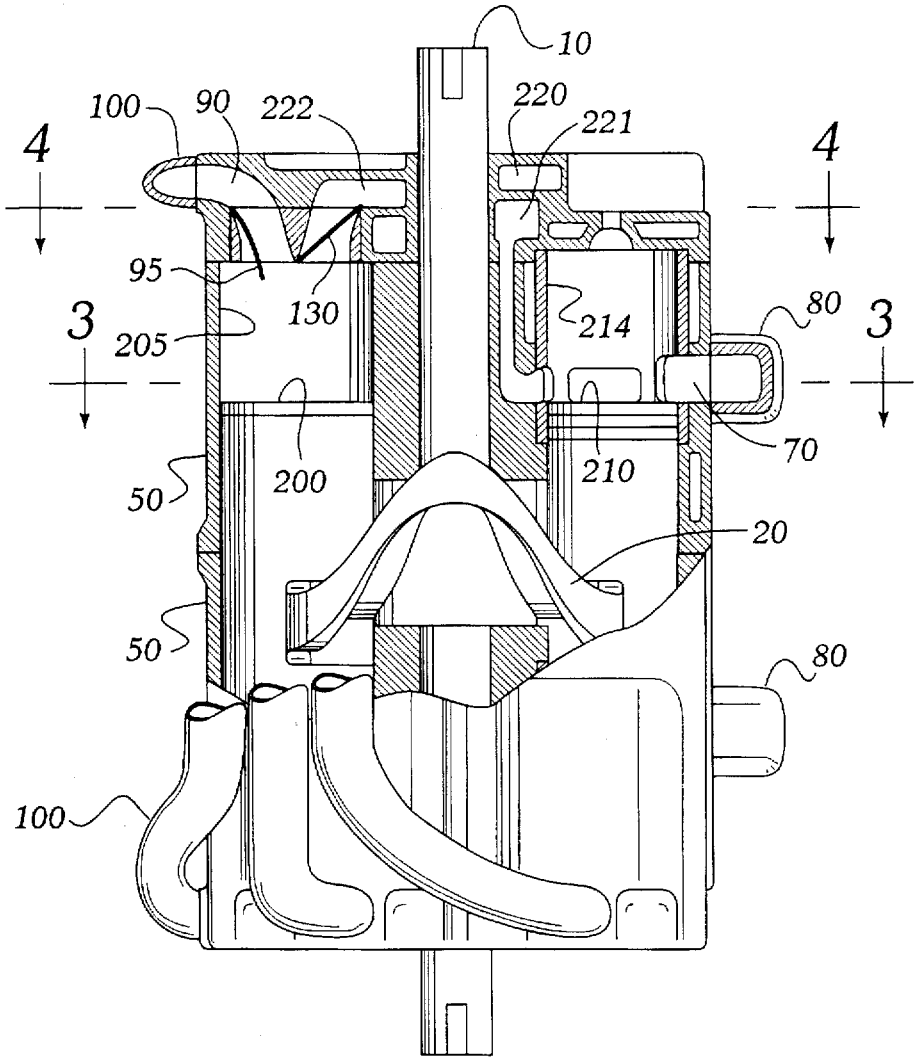
FIG. 2 shows a cutaway view of the engine assembly of the preferred embodiment of the present invention.
Figure 3:
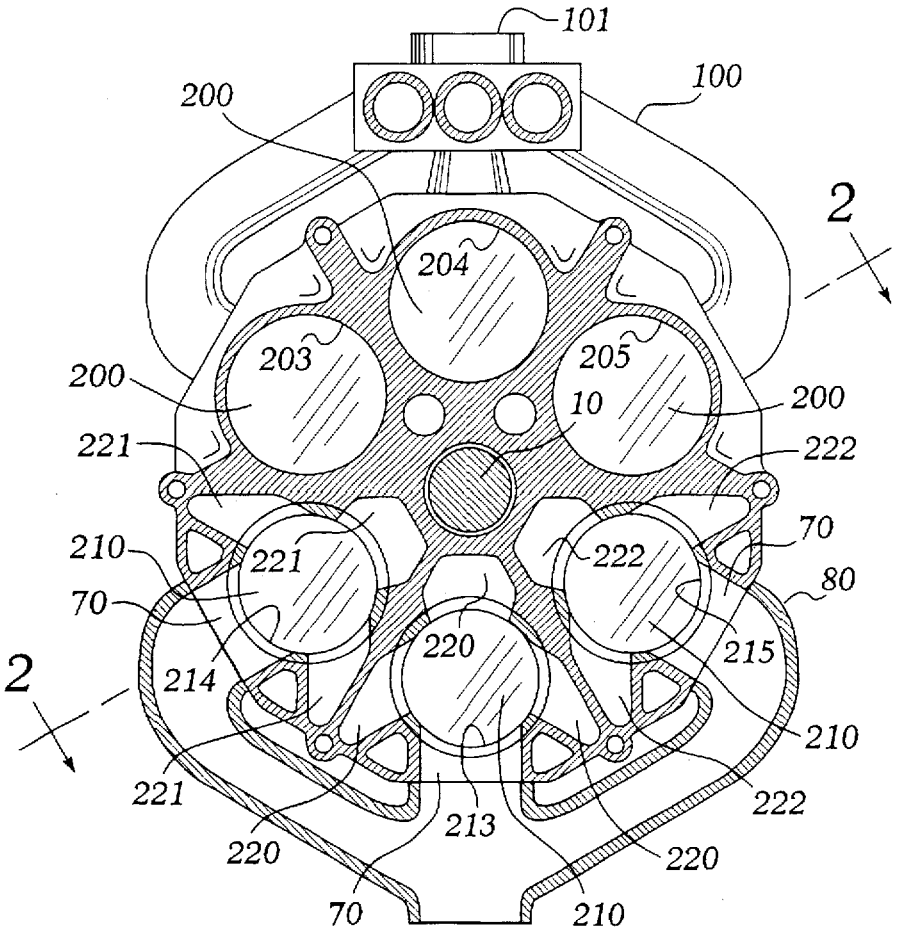
FIG. 3 is a cross-sectional view of an engine half of the preferred embodiment in the plane of exhaust ports.
Figure 4:
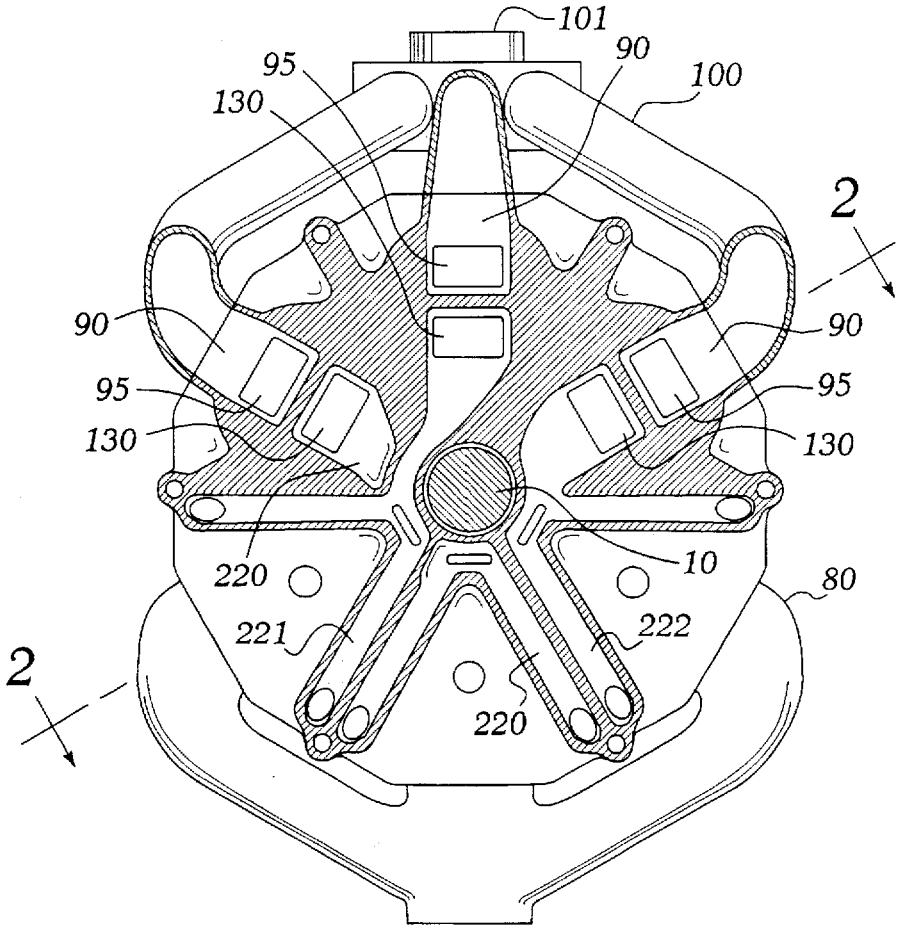
FIG. 4 is a cross-sectional view of an engine half of the preferred embodiment in the plane of intake ports and showing the transfer ducts.

The construction of the preferred embodiment of the present invention is illustrated in the cutaway view of FIG. 2 and is further illustrated in FIGS. 3 and 4. FIG. 2 shows the engine shaft 10 and cam 20 typical of a barrel type engine. The direction of engine shaft rotation is clockwise in FIGS. 2 and 3. Since the engine of the present invention possesses the high degree of symmetry typical of barrel type engines, the following description of engine operation references only one engine half but applies equally to both engine halves. The two halves of the engine of the present invention are treated as separate functional units for the purpose of describing engine operation. Sustained engine operation is possible with only one half of the engine functioning.

The engine assembly of the present invention includes a plurality of pumping pistons 200 and further includes a matching number of power pistons 210. In the preferred embodiment, the number of each type of pistons is three. The pumping pistons are slidably received in pumping cylinder bores 203, 204 and 205, and the power pistons are slidably received in power cylinder bores 213, 214 and 215. All three pumping cylinder bores 203, 204 and 205 are identical to each other in configuration, as are the three power cylinder bores 213, 214 and 215. The bores are numbered individually to identify them for the purpose of placing each pumping cylinder in communication with an appropriate power cylinder. Cylinder bore 203 is in communication with cylinder bore 213 by means of the transfer duct 220. A similar relationship exists between bore 204, bore 214 and duct 221, and between bore 205, bore 215, and duct 222.

The above-described arrangement results in a favorable timing relationship between the working cycles of the cylinders and further facilitates the construction of compact exhaust manifolds 80 as shown in FIGS. 3 and 4. The timing relationship and its benefits will be described hereinafter. The same timing relationship can be obtained by arranging power cylinders and pumping cylinders within an engine half alternatingly, so that no two adjacent cylinders are of the same type. However, the construction of intake and exhaust manifolds is made more difficult by the alternating arrangement than under the preferred arrangement.

Intake manifold 100 is shown further comprising a throttle body 101. Intake ports 90 are placed in communication with pumping cylinders by means of intake valves 95. The valves 95 are preferably a reed type, but may be of any type known in the art. It can be seen from the drawings that the configuration of the present invention facilitates the construction of an efficient path for the induction of intake charge into the pumping cylinders.

The intake charge is communicated from the pumping cylinders to appropriate power cylinders by means of transfer ducts 220, 221 and 222. Transfer valves 130 are provided within the ducts for purpose of example only and are not essential to the present invention. The geometry of the transfer ducts shown in FIGS. 3 and 4 is appropriate for loop scavenging, a common type of cylinder scavenging in two-stroke engine design. Other transfer duct geometries are possible to facilitate traditional and modified crossflow and uniflow scavenging designs.

Exhaust ports 70 of the present invention are in communication with exhaust manifolds 80 and are controlled by the power pistons 210 as is common in the art. The compact nature of exhaust manifolds 80 made possible under the present invention allows the engine of the present invention to take advantage of a cross-charging effect to further improve power output and efficiency. The cross-charging effect and other beneficial timing relationships of the present invention are described below.

In a typical barrel type engine, double-ended pistons 30 (of FIG. 1) follow pure harmonic motion in conjunction with a cam 20, which cam is coupled to the engine shaft 10. In a two-stroke cycle barrel type engine, one full revolution of the engine shaft 10 corresponds to two complete working cycles for each cylinder formed by each end of double ended piston 30 and its corresponding cylinder bore 40. Each working cycle taking place within 180 degrees of rotation of engine shaft 10 of a barrel type engine is equivalent to 360 degrees of crankshaft rotation in a conventional two-stroke cycle engine.

Figure 5:
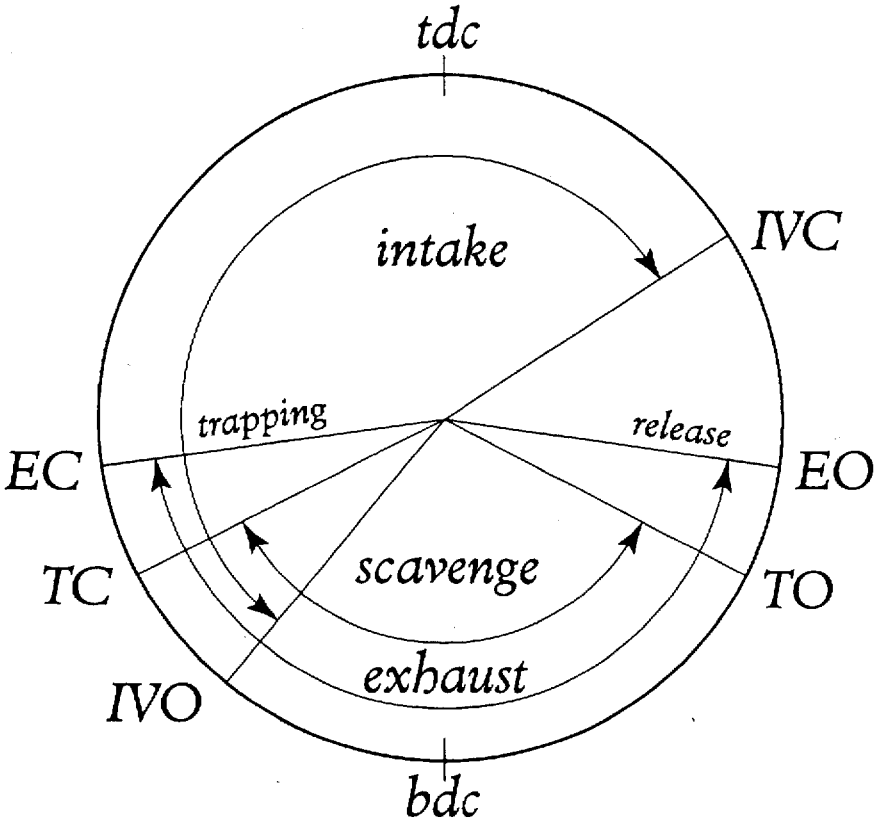
FIG. 5 is a diagrammatic view showing a 360 degree working cycle timing of an internal combustion engine utilizing a two-stroke cycle.

It is known in the art to describe working cycle event timing in terms of degrees of crankshaft rotation, as illustrated in FIG. 5. The timing of the events is shown relative to piston top dead center tdc and piston bottom dead center bdc. Within the context of the present invention, therefore, any discussion of working cycle event timing and corresponding 360 degree timing diagrams pertain to a single working cycle, comprising 180 degrees of rotation of engine shaft 10 of the present invention.

Using a two-stroke working cycle is well known in the art as a means to both reduce the complexity of an engine design and increase its power to weight ratio. The timing of working cycle events is controlled primarily by the motion of the power piston relative to ports machined into cylinder walls. When crankcase pumping action is used to transfer intake charge into the cylinder, as is common in the art, an intake valve is often added to control the flow of intake air into the crankcase.

A timing diagram illustrating such a cycle is shown in FIG. 5, with cycle events shown occurring sequentially in the clockwise direction. The piston bottom dead center bdc is a point which can be conveniently thought of as marking the completion of one working cycle and the start of the next working cycle. At this point, the crankcase compression is at its highest, typically at or slightly below 1.5 times atmospheric pressure, and the scavenging process is most vigorous in expelling the exhaust gas of the previous working cycle and replacing it with intake charge for the next cycle. Both exhaust ports and transfer ports are open, and the crankcase intake valve is closed.

After bdc, the crankcase pressure drops off rapidly and is at or below atmospheric pressure at intake valve opening IVO. This means that during most of the time between bdc and transfer port closure TC, little or no intake charge is being transferred into the cylinder and, in fact, intake charge is often spilled back into the crankcase. Until the exhaust port closure, EC intake charge is also being spilled out the exhaust port. Spilling of the intake charge significantly reduces the efficiency of the engine and may lead to unacceptable levels of pollutant emissions. It is therefore desirable to minimize the amount of time that transfer ports and exhaust ports are open after the point at which the transfer of intake charge into the cylinder stops. Such lower port timing would also extract the maximum work from exhaust gas expansion, resulting in greater thermal efficiency.

It is, however, necessary to keep the exhaust port open for sufficient amount of time between exhaust port opening EO and transfer port opening to allow the cylinder pressure to blow down below crankcase pressure. It is further necessary to keep the transfer ports open for sufficient time prior to bdc to allow the transfer of adequate amount of intake charge into the cylinder at the relatively low pumping pressure differential.

Since piston-controlled port timing is by nature symmetrical around bdc, the above requirements for early port openings are in direct conflict with the need for early port closing. A number of means exist in the art to minimize but not eliminate the compromise inherent in a traditional two-stroke cycle. It is common in the art to have EO occur at approximately 100 degrees after tdc, and to have the TO occur at approximately 120 degrees after tdc.

Figure 6:
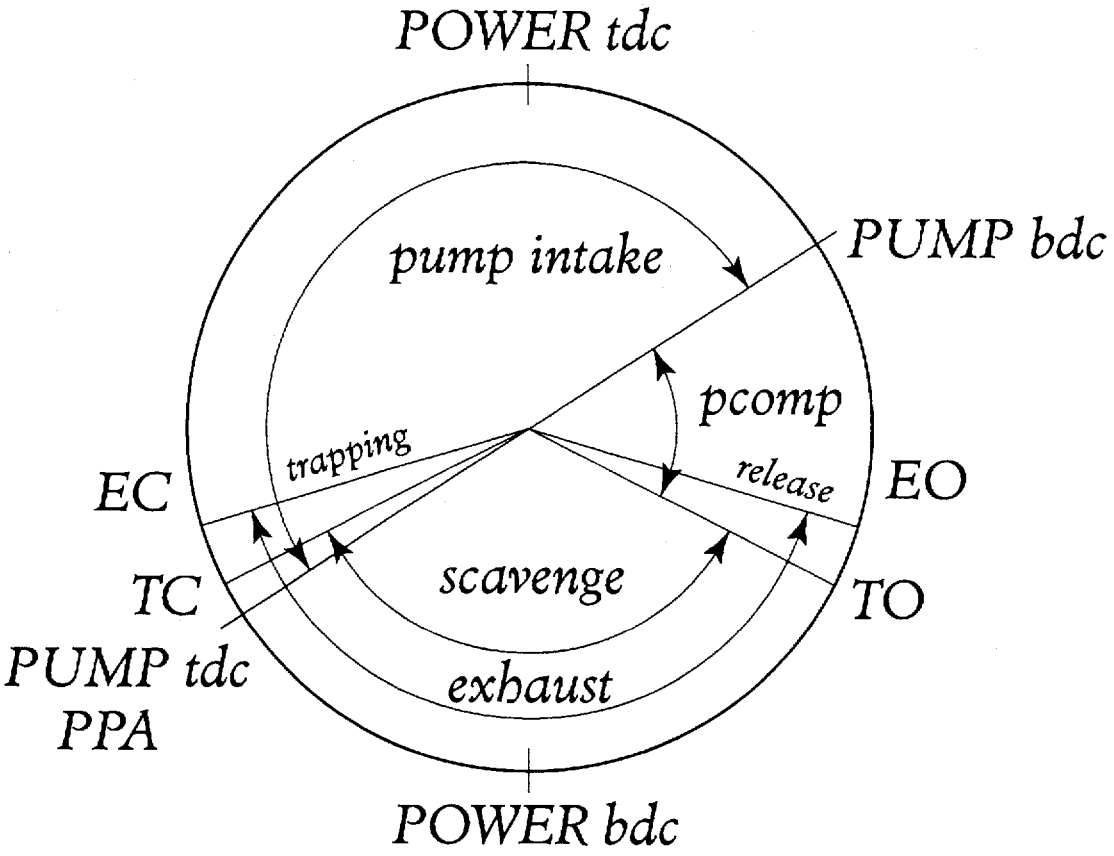
FIG. 6 is a diagrammatic view showing a 360 degree working cycle of the preferred embodiment of the engine of the present invention, equal to 180 degrees of engine shaft rotation.

A significant advantage of the present invention is the much higher compression ratio achievable by the use of separate pumping cylinders as compared to traditional crankcase pump. Higher compression facilitates higher intake charge transfer rates and therefore allows for the desirable low port timing. The fact that pumping cylinder volume of the present invention is greater than the power cylinder volume further enhances this beneficial effect to ensure more thorough cylinder filling. In the special case of the preferred embodiment of the present invention having three pumping cylinders and three power cylinders within each engine half an additional and significant benefit is derived from the natural timing relationship between the working cycles, as illustrated in FIG. 6. Other embodiments of the present invention are possible, including those with a different number of pistons, which possess the essential characteristics of the present invention but do not have said timing relationship of the preferred embodiment.

It is apparent from an examination of the preferred embodiment as set forth in the preceding description that the working cycle of any cylinder is advanced exactly 120 degrees with respect to the working cycle of the next cylinder within the same engine half in the direction of engine shaft rotation. It is then possible to arrange pumping cylinders and power cylinders within the same engine half so that each pumping cylinder is placed in communication with a power cylinder so that the working cycle of the pumping cylinder is advanced 120 degrees relative to the working cycle of the power cylinder, and to further have the working cycle of each power cylinder within an engine half be advanced 120 degrees relative to the working cycle of another power cylinder within said engine half.

Such an arrangement is illustrated in FIG. 3 and is further illustrated in FIG. 4, wherein a pumping cylinder formed by piston 200 and bore 203 is placed in communication with a power cylinder formed by piston 210 and bore 213 by means of transfer duct 220. A similar relationship exists between cylinders formed by pistons 200, 204, 210 and 214 and duct 221, and cylinders formed by pistons 200, 205, 210, 215 and duct 222. The benefits of such an arrangement are discussed below with reference to FIG. 6.

A key feature of the preferred embodiment is the fact that the intake charge is compressed progressively within the pumping cylinder from PUMP bdc, prior to transfer port opening TO, until PUMP tdc, immediately preceding transfer port closing TC. This compression combined with a relatively high compression ratio of the pumping cylinder ensures sufficient intake charge pressure to prevent backflow of exhaust gas into the transfer duct even with a low exhaust port opening EO and the resulting short blowdown period. Intake charge is then transferred into the power cylinder until immediately prior to transfer port closing TC, preventing any charge spilling back into the pumping cylinder.

Due to the previously described symmetry of timing, the close timing of EO and TO corresponds to a desirable close timing of TC and EC, minimizing intake charge spilling out the exhaust port. Such spilling is further reduced by the cross-charging effect resulting from the plugging pulse arrival PPA from another power cylinder.

The timing of PPA is substantially simultaneous with PUMP tdc and TC due to the working cycle of said another power cylinder being 120 degrees advanced relative to that of the power cylinder under discussion. The cross-charging effect is well know in the art as being characteristic of inline three-cylinder two-stroke engines having cylinder working cycles at 120 degree intervals and further having a compact exhaust manifold. The unique configuration of the preferred embodiment of the present invention facilitates taking advantage of this effect in a barrel type engine. An engine constructed in accordance with the present invention will exhibit a greatly reduced spilling of intake charge and will further have lower exhaust port timing than is possible with two-stroke engines of prior art, thereby significantly enhancing the efficiency of engine operation.

The above description of the present invention and the preferred embodiment is illustrative and not limiting. Other embodiments will become apparent to those skilled in the art based on the teachings of the present invention. The preferred embodiment of the present invention is characterized by an undersquare bore to stroke ratio, making it suitable for larger engines with low operational speed, and particularly suitable for diesel type of combustion. An embodiment having two power pistons and two pumping pistons would facilitate oversquare bore and stroke dimensions, and would be more appropriate for smaller spark-ignited engines and those with high operational speeds.

I claim:

1. An internal combustion engine of a barrel type comprising two halves, each half of said engine having a plurality of pumping cylinders and a plurality of power cylinders, said power cylinders being equal in number to said pumping cylinders, said power cylinders operating with a two-stroke working cycle, and said pumping cylinders and said power cylinders being formed by a number of pistons being slidably received within a corresponding number of cylinder bores, and, transfer ducts to place said pumping cylinders within each half of said engine in communication with said power cylinders within the same engine half.

2. The engine of claim 1 wherein said pumping cylinders are of larger diameter than said power cylinders.

3. The engine of claim 1 wherein said number of pistons comprise a plurality of identical double-ended pistons having a pumping end and a power end, each of said plurality of pumping cylinders of the first engine half being aligned with respective ones of said power cylinders of the second engine half, and each of said plurality of pumping cylinders of said second engine half being aligned with respective ones of said plurality of power cylinders of said first engine half.

4. The engine of claim 3 wherein said plurality of pumping cylinders are formed by the pumping end of each of said plurality of double-ended pistons being slidably received in respective ones of said cylinder bores.

5. The engine of claim 4 wherein said plurality of power cylinders are formed by the power end of each of said plurality of double-ended pistons being slidably received in respective ones of said cylinder bores.

6. The engine of claim 1 wherein said number of pistons comprise a plurality of double-ended pumping pistons and a plurality of double-ended power pistons, each of said plurality of pumping cylinders of the first half of said engine being aligned with respective ones of said plurality of pumping cylinders of the second engine half, and each of said plurality of power cylinders of said first engine half being aligned with respective ones of plurality of power cylinders of said second half.

7. The engine of claim 6 wherein said plurality of pumping cylinders are formed by one end of each of said plurality of double- ended pumping pistons being slidably received in respective ones of said cylinder bores.

8. The engine of claim 7 wherein said plurality of power cylinders are formed by one end of each of said plurality of double-ended power pistons being slidably received in respective ones of said cylinder bores.

9. The engine of claim 1 wherein the number of said plurality of pumping cylinders and the equal number of said plurality of power cylinders withing each half of said engine is two.

10. The engine of claim 1 wherein the number of said plurality of pumping cylinders and the equal number of said plurality of power cylinders within each half of said engine is three.

* * * * *